US008810147B2

(12) United States Patent
Hsieh

(10) Patent No.: US 8,810,147 B2
(45) **Date of Patent: *Aug. 19, 2014**

(54) METHOD AND CIRCUIT FOR DRIVING LEDS WITH A PULSED CURRENT

(76) Inventor: Wen-Hsiung Hsieh, Keelung (TW)

( * ) Notice: Subject to any disclaimer, the term of this patent is extended or adjusted under 35 U.S.C. 154(b) by 16 days.

This patent is subject to a terminal disclaimer.

(21) Appl. No.: 13/549,480

(22) Filed: Jul. 15, 2012

(65) Prior Publication Data

US 2014/0015437 A1 Jan. 16, 2014

(51) Int. Cl.

| | |
|---|---|
| ***H05B 41/16*** | (2006.01) |
| ***H05B 41/24*** | (2006.01) |
| *H05B 37/02* | (2006.01) |
| *H05B 39/02* | (2006.01) |
| *H05B 39/04* | (2006.01) |
| *H05B 41/36* | (2006.01) |

(52) U.S. Cl.
USPC ..... 315/254; 315/209 R; 315/246

(58) Field of Classification Search
None
See application file for complete search history.

(56) References Cited

U.S. PATENT DOCUMENTS

| | | | | |
|---|---|---|---|---|
| 6,304,464 | B1 | 10/2001 | Jacobs | |
| 6,577,072 | B2 | 6/2003 | Saito | |
| 6,577,512 | B2 * | 6/2003 | Tripathi et al. | 363/21.17 |
| 6,747,420 | B2 | 6/2004 | Barth | |
| 6,826,059 | B2 | 11/2004 | Böckle | |
| 7,071,630 | B1 | 7/2006 | York | |
| 7,245,089 | B2 | 7/2007 | Yang | |
| 7,259,525 | B2 | 8/2007 | Yang | |
| 7,378,805 | B2 | 5/2008 | Oh | |
| 7,439,945 | B1 | 10/2008 | Awalt | |
| 7,463,070 | B2 | 12/2008 | Wessels | |
| 7,557,521 | B2 | 7/2009 | Lys | |
| 7,579,786 | B2 | 8/2009 | Soos | |
| 7,633,463 | B2 | 12/2009 | Negru | |
| 7,688,009 | B2 | 3/2010 | Bayadroun | |
| 7,710,047 | B2 | 5/2010 | Shteynberg | |
| 7,746,300 | B2 | 6/2010 | Zhang | |
| 7,750,616 | B2 | 7/2010 | Liu | |
| 7,843,147 | B2 | 11/2010 | Chenetz | |
| 7,880,404 | B2 | 2/2011 | Deng | |
| 7,888,881 | B2 | 2/2011 | Shteynberg | |
| 8,040,102 | B2 | 10/2011 | Kao | |
| 8,120,201 | B2 | 2/2012 | Fujino | |
| 8,203,283 | B2 | 6/2012 | Hoogzaad | |
| 8,212,490 | B2 | 7/2012 | Ikegami | |
| 2007/0086223 | A1 * | 4/2007 | Uchida | 363/52 |
| 2010/0019696 | A1 * | 1/2010 | Kimura | 315/297 |
| 2012/0194078 | A1 * | 8/2012 | Ren et al. | 315/122 |

* cited by examiner

*Primary Examiner* — Douglas W Owens
*Assistant Examiner* — Dedei K Hammond

(57) ABSTRACT

A method of driving one or more than one light-emitting diodes with a pulsed current comprising: switching a first current flowing from a direct current (DC) voltage to an inductance apparatus comprising an inductor or a flyback transformer for charging the inductance apparatus; switching the pulsed current flowing from the light-emitting diodes to the inductance apparatus for transferring energy stored in the inductance apparatus to the light-emitting diodes; switching a second current flowing from the inductance apparatus to the direct current (DC) voltage for transferring energy stored in the inductance apparatus to the direct current (DC) voltage; wherein switching the first current, switching the pulsed current, and switching the second current are controlled to regulate the pulsed current supplied to the light-emitting diodes.

19 Claims, 4 Drawing Sheets

METHOD AND CIRCUIT FOR DRIVING LEDS WITH A PULSED CURRENT

TECHNICAL FIELD

The technical field of this disclosure is switching mode pulsed current regulator circuits, particularly, a pulsed current regulator circuit for driving one or more than one light-emitting diodes with a pulsed current.

BACKGROUND OF THE INVENTION

Significant advances have been made in the technology of white light-emitting diodes. White light-emitting diodes are commercially available which generate 60~100 lumens/watt. This is comparable to the performance of fluorescent lamps; therefore there have been a lot of applications in the field of lighting using white light-emitting diodes.

Various light-emitting diode driver circuits are known from the prior arts. For example, U.S. Pat. No. 6,304,464: "FLYBACK AS LED DRIVER"; U.S. Pat. No. 6,577,512: "POWER SUPPLY FOR LEDS"; and U.S. Pat. No. 6,747,420: "DRIVER CIRCUIT FOR LIGHT-EMITTING DIODES". All the light-emitting diode driver circuits mentioned above are constant current regulator circuits that act as constant current sources to drive light-emitting diodes.

In the field of lighting applications, for a white light-emitting diode lamp driven by a constant current source and a fluorescent lamp driven by an alternating current source under the condition that both lamps' remitted illumination have the same average illumination value, the fluorescent lamp provides higher perceived brightness levels than the white light-emitting diode lamp, the main reason is: human eyes are responsive to the peak value of illumination; therefore, if a lamp can provide higher peak illumination, it provides higher perceived brightness levels. For a fluorescent lamp driven by an alternating current (AC) source, it remits illumination with peak value higher than its average illumination value. But for a white light-emitting diode lamp driven by a constant current source, since light generation of a white light-emitting diode is dependent on the current strength through the white light-emitting diode, it remits illumination with peak value close to its average illumination value. Therefore, a white light-emitting diode lamp driven by a constant current regulator circuit constitutes a drawback of its remitted illumination with low perceived brightness levels.

It would be desirable to have a light-emitting diode driving circuit that would overcome the above disadvantages.

SUMMARY OF THE INVENTION

One aspect of the present invention provides a method of driving one or more than one light-emitting diodes with a pulsed current comprising the steps of: charging an inductance means via switching on a current flowing from a direct current (DC) voltage to the inductance means; discharging the inductance means via switching off the current flowing from the direct current (DC) voltage to the inductance means, and switching on a current flowing from said light-emitting diodes to the inductance means for transferring energy stored in the inductance means to said light-emitting diodes or switching on a current flowing from the inductance means to the direct current (DC) voltage for transferring energy stored in the inductance means to the direct current (DC) voltage; controlling said charging and discharging to regulate the current in the inductance means for supplying the pulsed current to said light-emitting diodes.

Accordingly, since light generation of a white light-emitting diode is dependent on the current strength through the white light-emitting diode, to drive a white light-emitting diode with a pulsed current can remit illumination with higher peak illumination value to provide higher perceived brightness levels than to drive it with a constant current, the switching mode pulsed current supply disclosed by this application provide a better solution for driving light emitting diodes.

Another aspect of the present invention provides a switching mode pulsed current supply circuit for driving light-emitting diodes having the advantage that the pulse width and the magnitude of the pulsed current supplied to the light-emitting diodes can be controlled independently.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

The detailed description set forth below in connection with the appended drawings is intended as a description of presently preferred embodiments of the invention and is not intended to represent the only forms in which the present invention may be constructed and or utilized.

Figure 1:
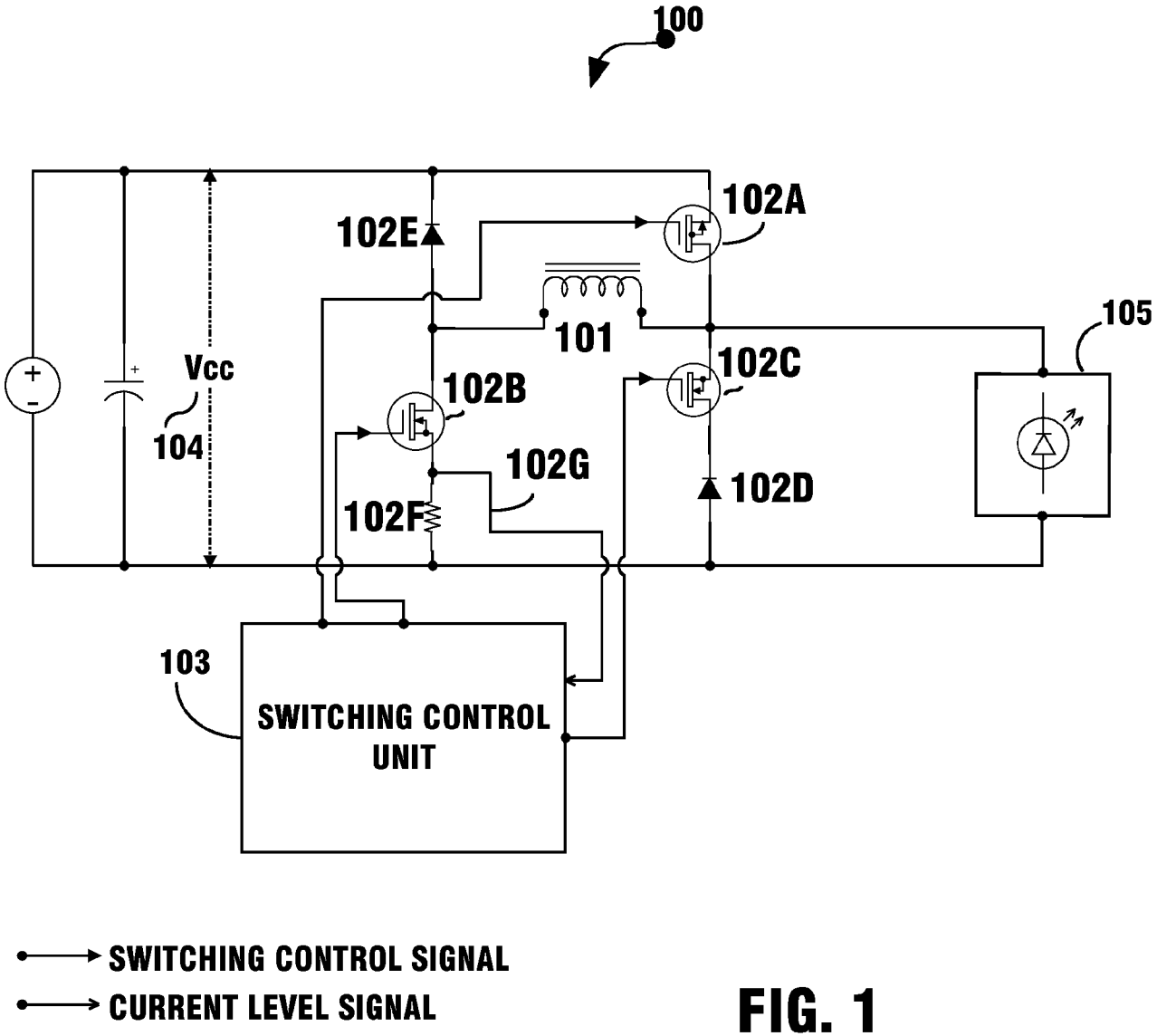
FIG. 1 is a block and circuit diagram illustrating an exemplary embodiment of a circuit according to the invention, wherein the inductance means is an inductor.

FIG. 1 is a block and circuit diagram illustrating an exemplary embodiment of a circuit 100 according to the invention, wherein the inductance means is an inductor 101.

As illustrated in FIG. 1, the switching mode pulsed current supply circuit 100 for supplying a pulsed current to one or more than one light-emitting diodes 105 is disclosed, said circuit comprising: an inductor 101; a switching unit comprising switches 102A, 102B and 102C coupled to the inductor 101, and diodes 102D and 102E for switching a current from a direct current (DC) voltage 104 to the inductor 101, for switching a current from said light-emitting diodes 105 to the inductor 101, and for switching a current flowing from the inductor 101 to the direct current (DC) voltage 104; an switching control unit 103 coupled to the switching unit to control its switching for supplying the pulsed current to said light-emitting diodes 105.

Figure 2:
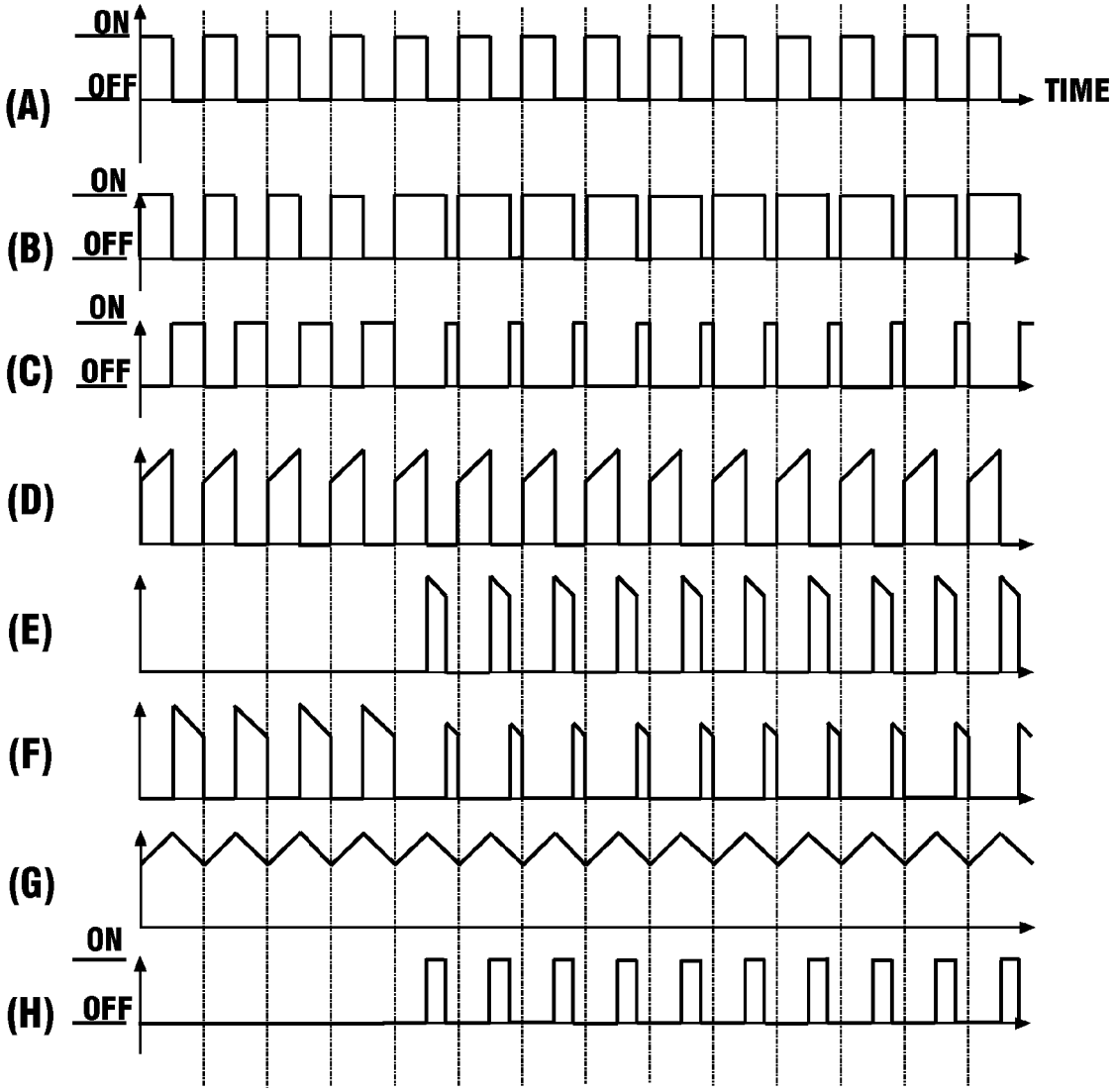
FIG. 2 shows exemplary waveform diagrams illustrating the various waveforms at different points of circuits in FIG. 1, FIG. 3 and FIG. 4 in accordance with the present invention.

FIG. 2 shows exemplary waveform diagrams illustrating the various waveforms at different points of circuits in FIG. 1 in accordance with the present invention.

As illustrated in FIG. 1 and FIG. 2, a non-limiting exemplary waveform of switching control signals from the switching control unit 103 to the switch 102A for controlling their switching is illustrated in FIG. 2(A); a non-limiting exemplary waveform of switching control signal from the switching control unit 103 to the switch 102B for controlling its switching is illustrated in FIG. 2(B); and a non-limiting exemplary waveform of switching control signal from the switching control unit 103 to the switch 102C for controlling its switching is illustrated in FIG. 2(C). According to the switching control signals from the switching control unit 103 to the switches 102A, 102B and 102C illustrated in FIGS. 2(A), 2(B) and 2(C), a non-limiting exemplary waveform of a current flowing from the direct current (DC) voltage 104 through the switch 102A to the inductor 101 is illustrated in FIG. 2(D); a non-limiting exemplary waveform of a current flowing from said light-emitting diodes 105 to the inductor 101 is illustrated in FIG. 2(E); a non-limiting exemplary waveform of a current flowing from the inductor 101 through the diode 102E to the direct current (DC) voltage 104 is illustrated in FIG. 2(F); a non-limiting exemplary waveform of a current flowing through the inductor 101 is illustrated in FIG. 2(G).

As illustrated in FIG. 1, the forward voltage of the diode 102D is less than the forward voltage of the light-emitting diodes 105. Therefore, when the switch 102C switches on, the light-emitting diodes 105 are bypassed.

As further illustrated in FIG. 1 and FIG. 2, the switches 102A, 102B and 102C switch on and off to charge and discharge the inductor 101 for providing a pulsed current to said light-emitting diodes 105: when the switch 102A and 102B switch on, the inductor 101 is charging energy from the direct current (DC) voltage 104; when the switch 102B switches on and the switches 102A and 102C both switch off, the energy stored in the inductor 101 is discharged to said light-emitting diodes 105; when the switch 102C switches on and the switches 102A and 102B both switch off, the energy stored in the inductor 101 is discharged back to the direct current (DC) voltage 104. Therefore, at steady state, the energy flow in and out of the inductor 101 are determined according to the duty ratio between the charging and discharging of the inductor 101 during each switching periods, therefore, this switching regulates the current of the inductor 101 for supplying a pulsed current illustrated in FIG. 2(E) to said light-emitting diodes 101. Accordingly, the pulse width of the pulsed current supplied to the light-emitting diodes 105 is controlled by the duty ratio between the discharging from the inductor to the light-emitting diodes 105 and the discharging from the inductor to the direct current (DC) voltage 104.

As further illustrated in FIG. 1 and FIG. 2, during the first four switching periods, the pulsed current flowing to the light-emitting diodes 105 is zero, and the current of the inductor 101 is kept by the switching of the switches 102A, 1028 and 102C. And during further switching periods, the pulsed current flowing to the light-emitting diodes 105 is controlled by duty between the switching of the switches 102B and 102C. Therefore, the pulse width of the pulsed current supplied to the light-emitting diodes 105 is adjustable under the same average or peak current of the inductor 101. From proper controlling the duty ratio between the discharging from the inductor 101 to the light-emitting diodes 105 and the discharging from the inductor 101 to the direct current (DC) voltage 104, the proper pulse width of the pulsed current can be got. From proper controlling the duty ratio between the charging and discharging of the inductor 101, the current of the inductor 101 can be regulated. Since these two controlling could be performed simultaneously, thus, the pulse width of the pulsed current is adjustable under the same average or peak current of the inductor 101. Therefore, the circuit 100 having the advantage that the pulse width and the magnitude of the pulsed current supplied to the light-emitting diodes 105 can be controlled independently.

As further illustrated in FIG. 1, the switching mode pulsed current supply circuit 100 further comprises a feedback current signal generator 102F to generate a feedback current signal 102G corresponding to the current of the inductor 101, wherein the switching control unit 103 integrates the feedback current signal 102G to process a feedback control.

Figure 3:
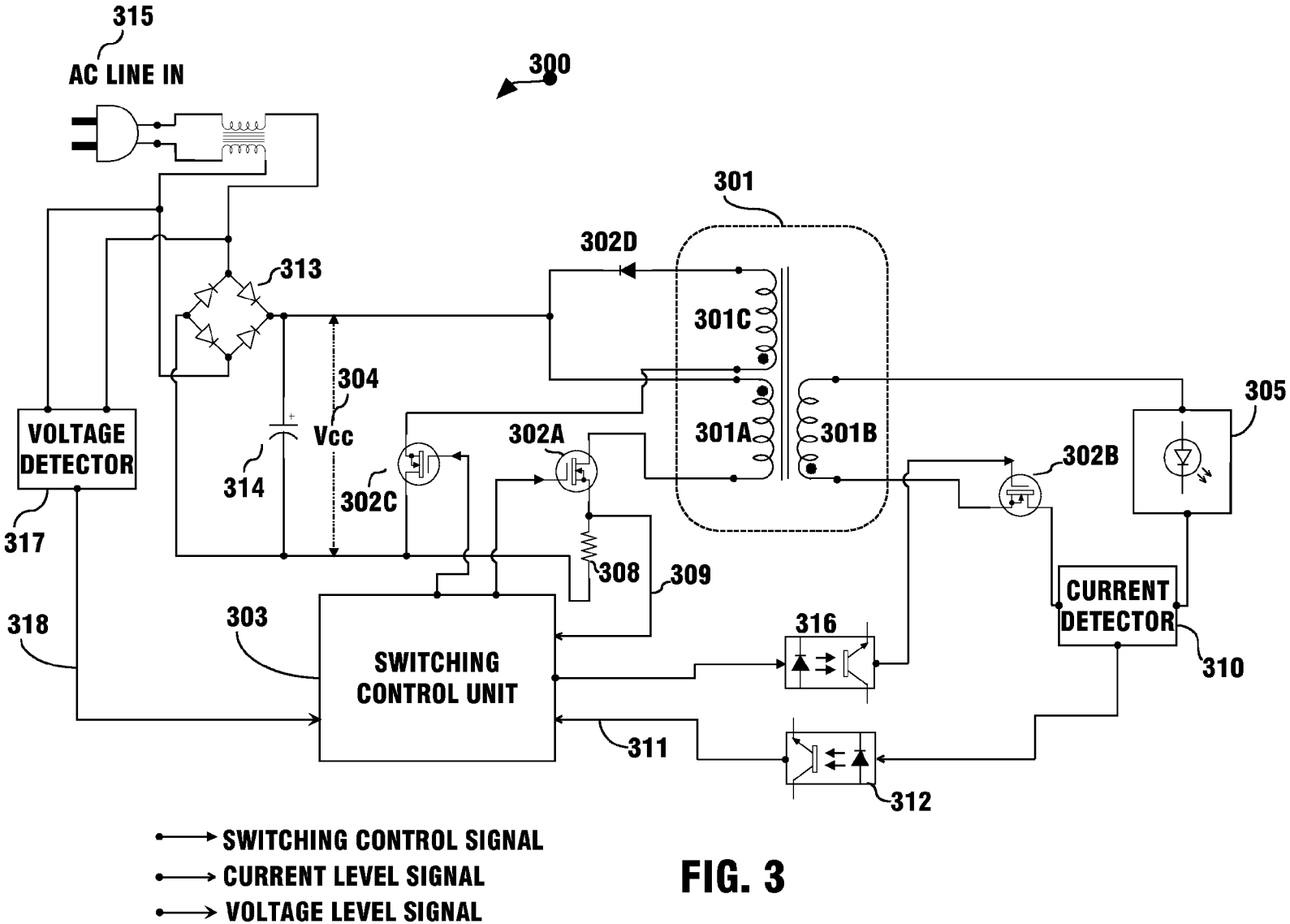
FIG. 3 is a block and circuit diagram illustrating an exemplary embodiment of a circuit according to the invention, wherein the inductance means is a flyback transformer with a winding for transferring energy stored in the inductance means to the direct current (DC) voltage.

As illustrated in FIG. 3, a circuit 300 for supplying a pulsed current to one or more than one light-emitting diodes 305 is disclosed, said circuit 300 comprising: an flyback transformer 301 comprising a primary winding 301A, a first secondary winding 301B and a second secondary winding 301C; a switching unit comprising switches 302A, 302B, 302C and a diode 302D for switching a current flowing from a direct current (DC) voltage 304 to the primary winding 301A, for switching a current flowing from said light-emitting diodes 305 to the first secondary winding 301B, and for switching a current flowing from the second secondary winding 301C to the direct current (DC) voltage 304; a switching control unit 303 coupled to the switches 302A, 302B, 302C to control their switching for supplying the pulsed current to said light-emitting diodes 305.

FIG. 2 shows exemplary waveform diagrams illustrating the various waveforms at different points of circuits in FIG. 3 in accordance with the present invention.

As illustrated in FIG. 3 and FIG. 2, a non-limiting exemplary waveform of switching control signals from the switching control unit 303 to the switch 302A for controlling its switching is illustrated in FIG. 2(A); a non-limiting exemplary waveform of switching control signal from the switching control unit 303 to the switch 302B for controlling its switching is illustrated in FIG. 2(H); and a non-limiting exemplary waveform of switching control signal from the switching control unit 303 to the switch 302C for controlling its switching is illustrated in FIG. 2(C). According to the switching control signals from the switching control unit 303 to the switches 302A, 302B and 302C illustrated in FIGS. 2(A), 2(H) and 2(C), a non-limiting exemplary waveform of a current flowing from the direct current (DC) voltage 304 to the primary winding 301A is illustrated in FIG. 2(D); a non-limiting exemplary waveform of a current flowing from said light-emitting diodes 305 to the first secondary winding 301B is illustrated in FIG. 2(E); a non-limiting exemplary waveform of a current flowing from the second secondary winding 301C to the direct current (DC) voltage 304 is illustrated in FIG. 2(F).

Accordingly, as further illustrated in FIG. 3 and FIG. 2, the switches 302A, 302B and 302C switch on and off for charging and discharging the flyback transformer 301 for providing a pulsed current: when the switch 302A switches on and the switches 302B and 302C switch off, the flyback transformer 301 is charging energy from the direct current (DC) voltage 304; when the switch 302B switches on and the switches 302A and 302C both switch off, the energy stored in the flyback transformer 301 is discharged to said light-emitting diodes 305; further when the switch 302C switches on and the switches 302A and 302B both switch off, the energy stored in the flyback transformer 301 is discharged back to the direct current (DC) voltage 304. Therefore, at steady state, the energy flow in and out of the flyback transformer 301 are determined according to the duty ratio between the charging and discharging during each switching periods, therefore, the switching of the switches 302A, 302B and 302C regulates the current of the flyback transformer 301 for driving the pulsed current illustrated in FIG. 2(E) flowing from said light-emitting diodes 305 to the first secondary winding 301B.

As further illustrated in FIG. 3 and FIG. 2, during the first four switching periods, the pulsed current flowing to the light-emitting diodes 305 is zero, and the current of the flyback transformer 301 is kept by the switching of the switches 302A and 302C. And during the further switching periods, the pulsed current flowing to the light-emitting diodes 305 is controlled by duty between the switching of the switches 302B and 302C. Therefore, the pulse width of the pulsed current supplied to the light-emitting diodes 305 is adjustable under the same average or peak current of the flyback transformer 301. From proper controlling the duty ratio between the discharging from the flyback transformer 301 to the light-emitting diodes 305 and the discharging from the flyback transformer 301 to the direct current (DC) voltage 304, the proper pulse width of the pulsed current supplied to the light-emitting diodes 305 can be got. From proper controlling the duty ratio between the charging and discharging of the flyback transformer 301, the current of the flyback transformer 301 can be regulated.

Accordingly, the pulse width of the pulsed current is adjustable under the same average or peak current of the flyback transformer 301. Therefore, the circuit 300 having the advantage of that the pulse width and the magnitude of the pulsed current supplied to the light-emitting diodes 305 can be controlled independently.

As further illustrated in FIG. 3, the switching mode pulsed current supply circuit 300 further comprises a feedback current signal generator 308 to generate a feedback current signal 309 corresponding to the current in the inductance means 301, wherein the switching control unit 303 integrates the feedback current signal 309 to process a feedback control.

As further illustrated in FIG. 3, the switching mode pulsed current supply circuit 300 further comprises a feedback signal generator 310 to generate a feedback signal 311 corresponding to the current of said light-emitting diodes 305, wherein the switching control unit 303 integrates the feedback signal 311 to process a feedback control.

As further illustrated in FIG. 3, the switching mode pulsed current supply circuit 300 further comprises a photo coupler 316 coupled between the switch 302B and the switching control unit 303 to provide electric isolation between the switch 302B and the switching control unit 303.

As further illustrated in FIG. 3, the switching mode pulsed current supply circuit 300 further comprises a photo coupler 312 coupled between the feedback signal generator 310 and the switching control unit 303 to provide electric isolation between the feedback signal generator 310 and the switching control unit 303.

As further illustrated in FIG. 3, the switching mode pulsed current supply circuit 300 further comprises a rectifying unit 313 and a smoothing unit 314 to rectify and smooth an alternating current (AC) voltage 315 and to provide the direct current (DC) voltage 304, wherein the rectifying unit 313 is a full bridge rectifier and the smoothing unit 314 is a capacitor.

As further illustrated in FIG. 3, the switching mode pulsed current supply circuit 300 further comprises an AC voltage signal generator 317 to generate an AC voltage signal 318 corresponding to the voltage of the alternating current (AC) voltage 315, wherein the switching control unit 303 integrates the AC voltage signal 318 to process a feedback control for power factor correction. For example, to regulate the pulse width of the pulsed current corresponding to the energy transferred to the light-emitting diodes 305 according to the AC voltage signal 318 for providing power factor correction.

As further illustrated in FIG. 3, the switching mode pulsed current supply circuit 300 further comprises means to synchronize the pulsed current supplied to the light-emitting diodes 305 and the alternating current (AC) voltage 315. For example, the switching control unit 303 integrates the AC voltage signal 318 to synchronize pulses of the pulsed current supplied to the light-emitting diodes 305 to the phase of the AC voltage signal 318.

For example, the switching control unit 303 integrates the AC voltage signal 318 to synchronize pulses of the pulsed current supplied to the light-emitting diodes 305 to the phase of the AC voltage signal 318. The advantage of this synchronization is: if there are more than one lighting apparatuses driven by a circuit 300 in a lighting area, then all the lighting apparatuses are synchronized according to the alternating current (AC) voltage 315, the AC mains, coupled to all the lighting apparatuses, thus, all the pulsed illumination from the light sources are synchronized according to the AC mains to generate pulsed illumination at same time to provide better perceived brightness level.

Figure 4:
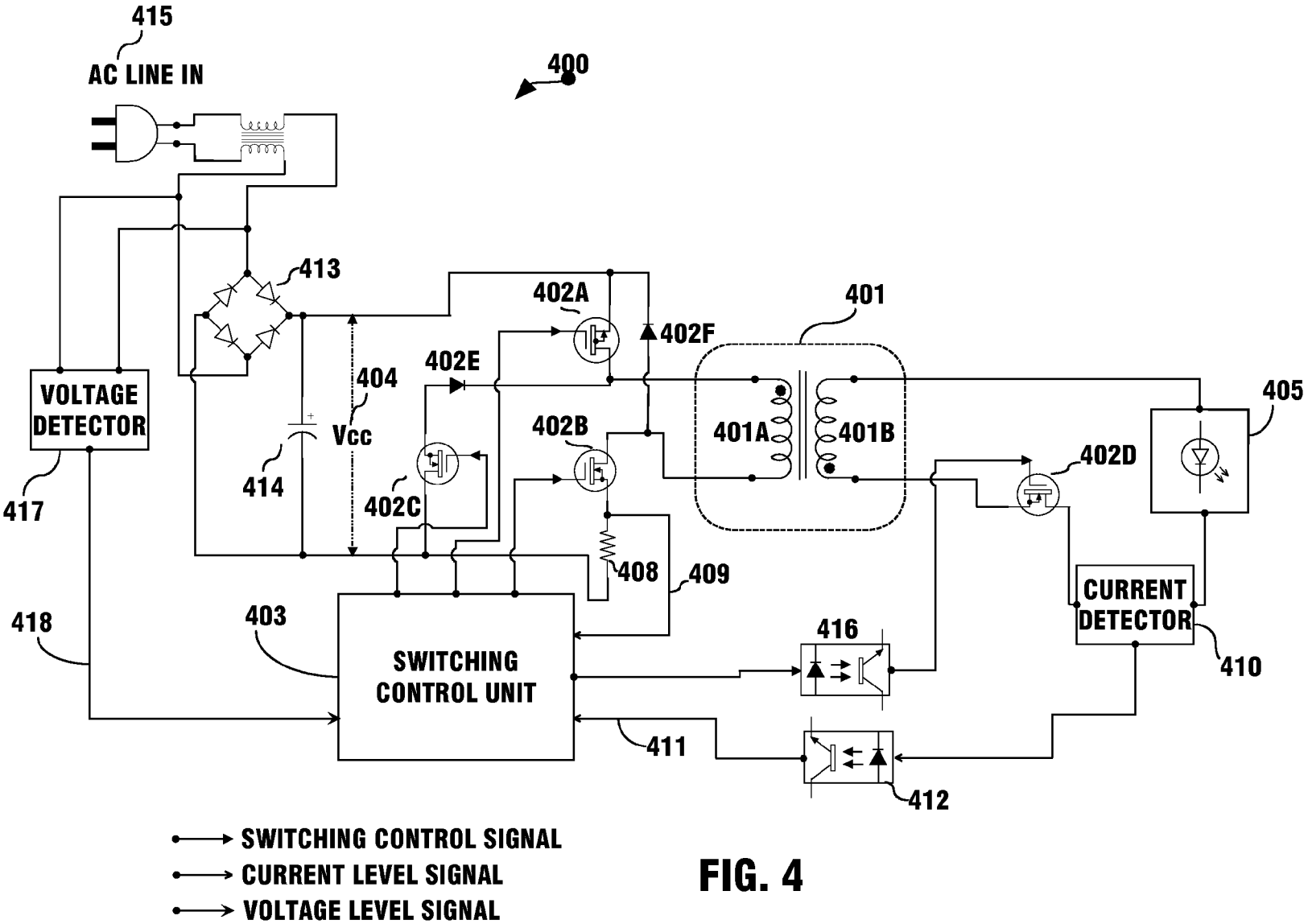
FIG. 4 is a block and circuit diagram illustrating an exemplary embodiment of a circuit according to the invention, wherein the inductance means is a flyback transformer using its primary winding for transferring energy from a direct current (DC) voltage to the inductance means, and for transferring energy stored in the inductance means to the direct current (DC) voltage.

As illustrated in FIG. 4, a circuit 400 for supplying a pulsed current to one or more than one light-emitting diodes 405 is disclosed, said circuit 400 comprising: an flyback transformer 401 comprising a primary winding 401A and a secondary winding 401B; a switching unit comprising switches 402A, 402B, 402C, 402D and diodes 402E, 402F for switching a current flowing from a direct current (DC) voltage 404 to the primary winding 401A, for switching a current flowing from said light-emitting diodes 405 to the secondary winding 401B, and for switching a current flowing from the primary winding 401A to the direct current (DC) voltage 404; a switching control unit 403 coupled to the switches 402A, 402B, 402C, 402D to control their switching for supplying the pulsed current to said light-emitting diodes 405.

FIG. 2 shows exemplary waveform diagrams illustrating the various waveforms at different points of circuits in FIG. 4 in accordance with the present invention.

As illustrated in FIG. 4 and FIG. 2, a non-limiting exemplary waveform of switching control signals from the switching control unit 403 to the switches 402A, 402B for controlling their switching is illustrated in FIG. 2(A); a non-limiting exemplary waveform of switching control signal from the switching control unit 403 to the switch 402D for controlling its switching is illustrated in FIG. 2(H); and a non-limiting exemplary waveform of switching control signal from the switching control unit 403 to the switch 402C for controlling its switching is illustrated in FIG. 2(C). According to the switching control signals from the switching control unit 403 to the switches 402A, 402B, 402C and 402D illustrated in FIGS. 2(A), 2(H) and 2(C), a non-limiting exemplary waveform of a current flowing from the direct current (DC) voltage 404 through the switch 402A to the primary winding 401A is illustrated in FIG. 2(D); a non-limiting exemplary waveform of a current flowing from said light-emitting diodes 405 to the secondary winding 401B is illustrated in FIG. 2(E); a non-limiting exemplary waveform of a current flowing from the primary winding 401A through the diode 402F to the direct current (DC) voltage 404 is illustrated in FIG. 2(F).

Accordingly, as further illustrated in FIG. 4 and FIG. 2, the switches 402A, 402B, 402C and 402D switch on and off for charging and discharging the flyback transformer 401 for providing a pulsed current: when the switches 402A, 402B switch on and the switches 402C and 402D switch off, the flyback transformer 401 is charging energy from the direct current (DC) voltage 404; when the switch 402D switches on and the switches 402A, 402B and 402C switch off, the energy stored in the flyback transformer 401 is discharged to said light-emitting diodes 405; when the switch 402C switches on and the switches 402A, 402B and 402D switch off, the energy stored in the flyback transformer 401 is discharged back to the direct current (DC) voltage 404. Therefore, at steady state, the energy flow in and out of the flyback transformer 401 are determined according to the duty ratio between the charging and discharging during each switching periods, therefore, the switching of the switches 402A, 402B, 402C and 402D regulates the current of the flyback transformer 401 for driving the pulsed current illustrated in FIG. 2(E) from said light-emitting diodes 405 to the secondary winding 401B.

As further illustrated in FIG. 4 and FIG. 2, during the first four switching periods, the pulsed current flowing to the light-emitting diodes 405 is zero, and the current of the flyback transformer 401 is kept by the switching of the switches 402A, 402B and 402C. And during the further switching periods, the pulsed current flowing to the light-emitting diodes 405 is controlled by duty between the switching of the switches 402C and 402D. Therefore, the pulse width of the pulsed current is adjustable under the same average or peak current of the flyback transformer 401. From proper controlling the duty ratio between the discharging from the flyback transformer 401 to the light-emitting diodes 405 and the discharging from the flyback transformer 401 to the direct current (DC) voltage 404, the proper pulse width of the pulsed current supplied to the light-emitting diodes 405 can be got. From proper controlling the duty ratio between the charging and discharging of the flyback transformer 401, the current of the flyback transformer 401 can be regulated.

Accordingly, the pulse width of the pulsed current supplied to the light-emitting diodes 405 is adjustable under the same average or peak current of the flyback transformer 401. Therefore, the circuit 400 having the advantage of that the pulse width and the magnitude of the pulsed current supplied to the light-emitting diodes 405 can be controlled independently.

As further illustrated in FIG. 4, the switching mode pulsed current supply circuit 400 further comprises a feedback current signal generator 408 to generate a feedback current signal 409 corresponding to the current in the inductance means 401, wherein the switching control unit 403 integrates the feedback current signal 409 to process a feedback control.

As further illustrated in FIG. 4, the switching mode pulsed current supply circuit 400 further comprises a feedback signal generator 410 to generate a feedback signal 411 corresponding to the current of said light-emitting diodes 405, wherein the switching control unit 403 integrates the feedback signal 411 to process a feedback control.

As further illustrated in FIG. 4, the switching mode pulsed current supply circuit 400 further comprises a photo coupler 416 coupled between the switch 402D and the switching control unit 403 to provide electric isolation between the switch 402D and the switching control unit 403.

As further illustrated in FIG. 4, the switching mode pulsed current supply circuit 400 further comprises a photo coupler 412 coupled between the feedback signal generator 410 and the switching control unit 403 to provide electric isolation between the feedback signal generator 410 and the switching control unit 403.

As further illustrated in FIG. 4, the switching mode pulsed current supply circuit 400 further comprises a rectifying unit 413 and a smoothing unit 414 to rectify and smooth an alternating current (AC) voltage 415 and to provide the direct current (DC) voltage 404, wherein the rectifying unit 413 is a full bridge rectifier and the smoothing unit 414 is a capacitor.

As further illustrated in FIG. 4, the switching mode pulsed current supply circuit 400 further comprises an AC voltage signal generator 417 to generate an AC voltage signal 418 corresponding to the voltage of the alternating current (AC) voltage, wherein the switching control unit 403 integrates the AC voltage signal 418 to process a feedback control for power factor correction. For example, to regulate the energy transferred to the light-emitting diodes 405 according to the AC voltage signal 418 for providing power factor correction.

As further illustrated in FIG. 4, the switching mode pulsed current supply circuit 400 further comprises means to synchronize the pulsed current supplied to the light-emitting diodes 405 and the alternating current (AC) voltage 415. For example, the switching control unit 403 integrates the AC voltage signal 418 to synchronize pulses of the pulsed current supplied to the light-emitting diodes 405 according to the phase of the AC voltage signal 418. The advantage of this synchronization is: if there are more than one lighting apparatuses driven by a circuit 400 in a lighting area, then all the lighting apparatuses are synchronized according to the alternating current (AC) voltage 415, the AC mains, coupled to all the lighting apparatuses, thus, all the pulsed illumination from the light sources are synchronized according to the AC mains to generate pulsed illumination at same time to provide better perceived brightness level.

Accordingly, since light generation of a white light-emitting diode is dependent on the current strength through the white light-emitting diode, to drive a white light-emitting diode with a pulsed current can remit illumination with higher peak illumination value to provide higher perceived brightness levels than to drive it with a constant current, the switching mode pulsed current supplies 100, 300, 400 provide a better solution for driving light emitting diodes.

Another aspect of the present invention provides switching mode pulsed current supplies 100, 300, 400 for driving light-emitting diodes having the advantage of that the pulse width and the magnitude of the pulsed current supplied to the light-emitting diodes can be controlled independently.

It is to be understood that the above described embodiments are merely illustrative of the principles of the invention and that other arrangements may be devised by those skilled in the art without departing from the spirit and scope of the invention.

What claimed is:

1. A circuit for supplying a pulsed current to one or more than one light-emitting diodes, said circuit comprising:

an inductance means;

a switching unit comprising a plurality of switches and coupled to the inductance means for switching a current flowing from a direct current (DC) voltage to the inductance means for charging the inductance means, for switching the pulsed current flowing from said light-emitting diodes to the inductance means for discharging the inductance means to said light-emitting diodes, and for switching a current flowing from the inductance means to the direct current (DC) voltage for discharging the inductance means to the direct current (DC) voltage;

a switching control unit coupled to the switching unit to control said switches to regulate the pulsed current supplied to said light-emitting diodes.

2. The circuit according to claim 1, further comprising:
a feedback current signal generator to generate a feedback current signal corresponding to the current of the inductance means,
wherein the switching control unit integrates the feedback current signal to process a feedback control.

3. The circuit according to claim 1, further comprising:
a feedback signal generator to generate a feedback signal corresponding to the current of said light-emitting diodes,
wherein the switching control unit integrates the feedback signal to process a feedback control.

4. The circuit according to claim 2, further comprising:
an isolator circuit coupled between the feedback current signal generator and the switching control unit to provide electric isolation between the feedback current signal generator and the switching control unit.

5. The circuit according to claim 3, further comprising:
an isolator circuit coupled between the feedback signal generator and the switching control unit to provide electric isolation between the feedback signal generator and the switching control unit.

6. The circuit according to claim 1, further comprising:
one or more than one isolator circuits coupled between the switching unit and the switching control unit to provide electric isolation between the first switching unit and the switching control unit.

7. The circuit according to claim 1, further comprising:
a rectifying and smoothing unit to rectify and smooth an alternating current (AC) voltage for providing the direct current (DC) voltage.

8. The circuit according to claim 7, further comprising:
an alternating current (AC) voltage signal generator to generate an alternating current (AC) voltage signal corresponding to the voltage of the alternating current (AC) voltage,
wherein the switching control unit integrates the alternating current (AC) voltage signal to process a control for power factor correction.

9. The circuit according to claim 8, further comprising:
The switching control unit further processes an synchronization between the pulses of the pulsed current supplied to said light-emitting diodes and the phase of the alternating current (AC) voltage according to the alternating current (AC) voltage signal.

10. The circuit according to claim 1, wherein the inductance means comprises an inductor or a flyback transformer.

11. The circuit according to claim 10, wherein the flyback transformer comprises:
a primary winding for charging the flyback transformer;
a first secondary winding for discharging the flyback transformer to said light-emitting diodes;
a second secondary winding or using the primary winding for discharging the flyback transformer to the direct current (DC) voltage.

12. A method of driving one or more than one light-emitting diodes with a pulsed current comprising:
switching a first current flowing from a direct current (DC) voltage to an inductance means for charging the inductance means;
switching the pulsed current flowing from said light-emitting diodes to the inductance means for transferring energy stored in the inductance means to said light-emitting diodes;
switching a second current flowing from the inductance means to the direct current (DC) voltage for transferring energy stored in the inductance means to the direct current (DC) voltage;
wherein switching the first current, switching the pulsed current, and switching the second current are controlled to regulate the pulsed current supplied to said light-emitting diodes.

13. The method of claim 12 further comprising:
getting a feedback current signal by detecting the current of the inductance means and integrating the feedback current signal to process a feedback control.

14. The method of claim 12 further comprising:
getting a feedback signal by detecting the current of said light-emitting diodes and integrating the feedback signal to process a feedback control.

15. The method of claim 12 further comprising:
rectifying and smoothing an alternating current (AC) voltage for obtaining the direct current (DC) voltage.

16. The method of claim 15 further comprising:
getting an alternating current (AC) voltage signal by detecting the voltage of the alternating current (AC) voltage and integrating the alternating current (AC) voltage signal to process a control for power factor correction.

17. The method of claim 16 further comprising:
synchronizing the pulses of the pulsed current supplied to the light-emitting diodes to the phase of the alternating current (AC) voltage.

18. The method according to claim 12, wherein the inductance means comprises an inductor or a flyback transformer.

19. The method according to claim 18, wherein the flyback transformer comprises:
a primary winding for charging the flyback transformer;
a first secondary winding for discharging the flyback transformer to said light-emitting diodes;
a second secondary winding or using the primary winding for discharging the flyback transformer to the direct current (DC) voltage.

* * * * *